US008640978B2

(12) United States Patent
Gregory et al.

(10) Patent No.: US 8,640,978 B2
(45) **Date of Patent: *Feb. 4, 2014**

(54) IRRIGATION SPRINKLER NOZZLE WITH ENHANCED CLOSE-IN WATER DISTRIBUTION

(75) Inventors: Christian T. Gregory, La Crescenta, CA (US); John J. Alarcon, Claremont, CA (US)

(73) Assignee: Rain Bird Corporation, Azusa, CA (US)

( * ) Notice: Subject to any disclaimer, the term of this patent is extended or adjusted under 35 U.S.C. 154(b) by 723 days.

This patent is subject to a terminal disclaimer.

(21) Appl. No.: 12/025,499

(22) Filed: Feb. 4, 2008

(65) Prior Publication Data

US 2008/0185457 A1 Aug. 7, 2008

Related U.S. Application Data

(63) Continuation of application No. 10/632,268, filed on Jul. 31, 2003, now Pat. No. 7,325,753.

(51) Int. Cl.
*B05B 1/26* (2006.01)

(52) U.S. Cl.
USPC ..... 239/522; 239/596; 239/601

(58) Field of Classification Search
USPC ..... 239/502, 504, 518, 521, 522, 524, 596, 239/601
See application file for complete search history.

(56) References Cited

U.S. PATENT DOCUMENTS

| | | | | |
|---|---|---|---|---|
| 2,778,687 | A * | 1/1957 | Hegstad | 239/601 |
| 2,936,960 | A * | 5/1960 | Thompson | 239/458 |
| 3,266,737 | A * | 8/1966 | Nees | 239/548 |
| 7,325,753 | B2 * | 2/2008 | Gregory et al. | 239/522 |

* cited by examiner

*Primary Examiner* — Christopher Kim
(74) *Attorney, Agent, or Firm* — Fitch, Even, Tabin & Flannery, LLP

(57) ABSTRACT

An improved irrigation sprinkler nozzle is provided for enhanced short range or close-in distribution of water for irrigating vegetation and the like positioned relatively close to the sprinkler. The improved sprinkler nozzle includes a nozzle passage for outward projection of a water stream, at least a portion of which is defined by a generally vertically oriented, fan-shaped spray pattern. A lower margin of the nozzle passage defining this fan-shaped pattern is lined with a plurality of forwardly extending ramps each formed with a selected width and a different declination angle. A portion of the water discharged through the nozzle passage is forced and guided downwardly along these ramps for enhanced close-in distribution of water near the sprinkler.

27 Claims, 4 Drawing Sheets

IRRIGATION SPRINKLER NOZZLE WITH ENHANCED CLOSE-IN WATER DISTRIBUTION

BACKGROUND OF THE INVENTION

This invention relates generally to improvements in spray nozzles for irrigation sprinklers. More particularly, this invention relates to a sprinkler nozzle construction designed to produce a highly controllable and enhanced water stream spray pattern for achieving significantly improved short range or close-in distribution of water for irrigating vegetation and the like positioned relatively close to the sprinkler.

In a typical irrigation system, a plurality of sprinklers are provided for distributing irrigation water in a plurality of overlapping stream spray patterns for irrigating a selected terrain area. These sprinklers may include rotatably driven or so-called fixed spray heads each including one or more spray nozzles designed for outward projection of respective water streams over a designated part-circle or full-circle terrain area. Since the distribution of irrigation water for each water stream is typically nonuniform over the projected range thereof, overlapping water stream spray patterns are normally provided in an attempt to improve the overall uniformity of water distribution throughout the irrigated terrain area.

In this regard, significant design effort has been directed to the provision of a sprinkler spray nozzle capable of providing a predetermined and controllable distribution of irrigation water throughout the range of the projected water stream. A wide variety of different spray nozzle configurations have been developed for enhancing or increasing the maximum range, thereby permitting a specified terrain area to be irrigated by a reduced number of sprinklers. In general, however, sprinkler spray nozzles have not provided for adequate short range or close-in distribution for irrigating a terrain zone typically within about 1-1½ feet from the sprinkler. As a result, this close-in terrain zone and associated vegetation located therein can be inadequately irrigated.

Improved sprinkler spray nozzles have been designed with the intent to provide enhanced close-in water distribution. For the most part, such nozzle designs have envisioned the use of multiple nozzles or nozzle outlets, at least one of which is specially contoured to provide a distorted or low pressure spray pattern so that a greater proportion of the outwardly projected water stream will fall to the ground at a location closer to the sprinkler. See, for example, U.S. Pat. Nos. 5,240,182; 5,240,184; 5,598,977; 5,642,861; and 5,299,742. In another design, a single composite nozzle passage is provided to produce a relatively high velocity stream segment for long range irrigation and a comparatively lower velocity stream segment for short range or close-in irrigation. See, for example, U.S. Pat. No. 5,676,315. While spray nozzle configurations have achieved improvements in close-in water distribution, adequate and satisfactory close-in delivery of irrigation water to a terrain zone immediately adjacent the sprinkler continues to be a problem. In addition, in many such spray nozzles, the close-in water distribution takes the form of relatively high velocity water droplets which can undesirably erode and wash away or otherwise disturb newly planted seed, such as grass seed used in a newly planted lawn.

There exists, therefore, a need for further improvements in and to sprinkler spray nozzles, particularly with respect to providing enhanced short range or close-in distribution of irrigation water. Moreover, there exists a need to provide such improved close-in water distribution in the form of relatively small, relatively low velocity water droplets which do not disturb newly planted seed. The present invention fulfills these needs and provides further related advantages.

SUMMARY OF THE INVENTION

In accordance with the invention, an improved irrigation sprinkler nozzle is provided for enhanced short range or close-in distribution of water for irrigating vegetation and the like positioned relatively close to the sprinkler. The improved sprinkler nozzle includes a nozzle passage terminating in a nozzle outlet for outward projection of a water stream, at least a lower portion of which is defined by a generally vertically oriented, fan-shaped spray pattern. A lower margin of the nozzle outlet is lined with a plurality of forwardly extending ramps each formed with a selected width and a different declination angle. A portion of the water discharged through the nozzle outlet is forced and guided downwardly along these ramps for enhanced close-in distribution of water near the sprinkler.

In the preferred form, the sprinkler nozzle is provided as a separate component for removable mounting onto a sprinkler spray head of the type adapted for installation onto an upper end of a tubular riser which can be rotatably driven or fixed, and/or designed for pop-up movement relative to a sprinkler housing. The improved nozzle defines the nozzle passage having an upstream end for receiving water inflow from the riser, and a downstream end defined by the nozzle outlet through which the water stream is projected generally outwardly with a selected inclination angle for delivering the irrigation water to the surrounding terrain area. In one preferred form, the nozzle outlet is shaped to define an upper segment for producing a relatively long range stream segment for delivering a portion of the water stream over a terrain zone disposed a substantial distance from the sprinkler. The nozzle outlet further includes a lower segment having means such as laterally converging or tapered transition surfaces at an upstream or inboard side thereof for constricting the water flow to produce the generally vertically oriented fan-shaped spray pattern for comparatively close-in water distribution. In a rotating stream sprinkler wherein the spray head is rotatably driven to sweep the projected water stream in a part-circle or full-circle path over the surrounding terrain, one preferred nozzle outlet geometry comprises a generally tombstone shape having a generally arched or semicircular upper margin joined to relative straight side margins which are joined in turn to the lower margin which is also relatively straight.

The lower margin of the nozzle outlet is lined, by the plurality of forwardly extending ramps of selected widths and selected different declination angles. In one preferred form, three or more ramps are provided in side-by-side array, and include upstream ends disposed at least a short distance upstream from a front face plane of the nozzle. In addition, the upstream ends of the downwardly angled ramps are disposed at least a short distance downstream from initial constriction of the water flow by the tapered transition surfaces or other suitable means at the inboard side of the nozzle outlet to produce the vertically oriented fan spray pattern. The ramps extend forwardly and downwardly from their upstream ends, at their respective declination angles, and terminate at downstream ends which may be disposed substantially at or beyond the front face plane of the nozzle.

With this construction, a portion of the water projected under pressure through the nozzle outlet is forced and guided downwardly by these ramps for improved close-in distribution near the sprinkler. In addition, by forming the ramps upstream or inboard relative to the nozzle front face plane, and downstream relative to initial lateral constriction of the water flow to produce the vertical fan spray pattern, the downwardly angled ramps are believed to provide a localized rapid expansion in the cross sectional area of the nozzle passage and a corresponding rapid localized pressure reduction for converting this localized region of the water stream into relatively small droplets at relatively low velocity. As a result, the lower edge of the fan-like stream pattern for close-in watering falls to the ground in the form of a relatively soft droplets that do not disturb or erode freshly planted seed.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
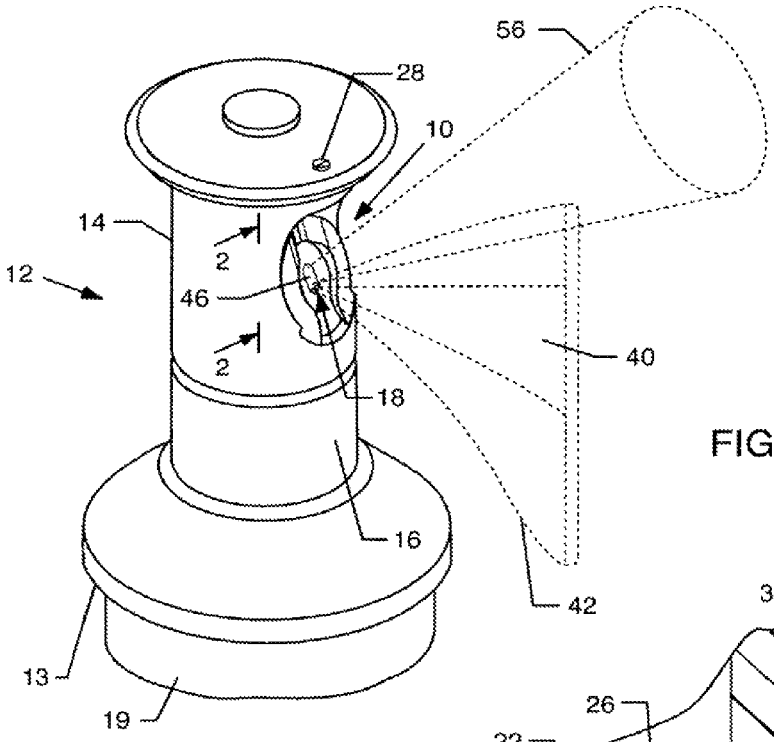
FIG. 1 is a fragmented perspective view illustrating an irrigation sprinkler including a spray head mounted onto an upper end of a rotatably driven pop-up riser, wherein the spray head includes an improved sprinkler nozzle constructed in accordance with the present invention for enhanced close-in water distribution.
Figure 2:
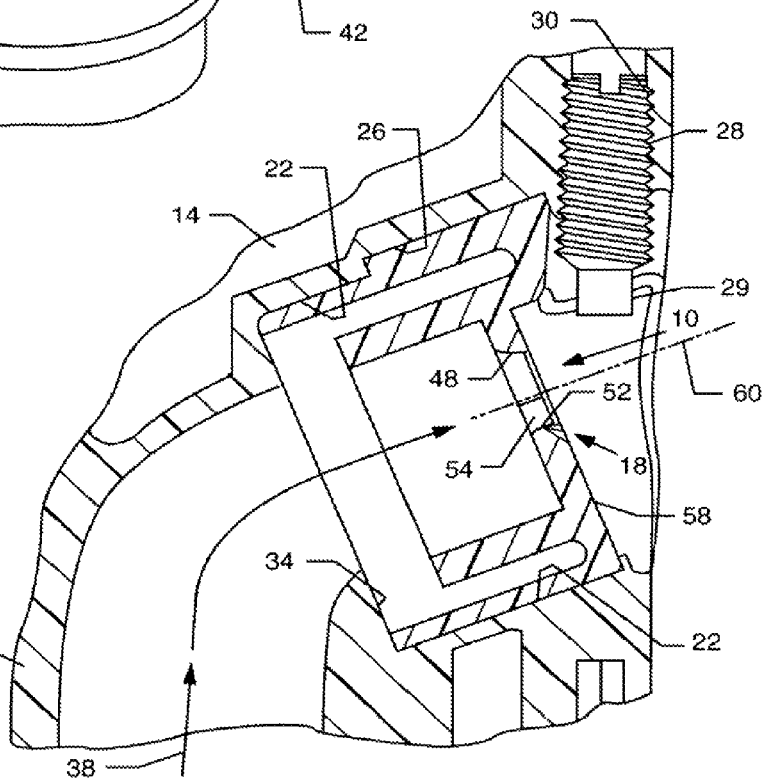
FIG. 2 is an enlarged and fragmented vertical sectional view taken generally on the line 2-2 of FIG. 1.
Figure 3:
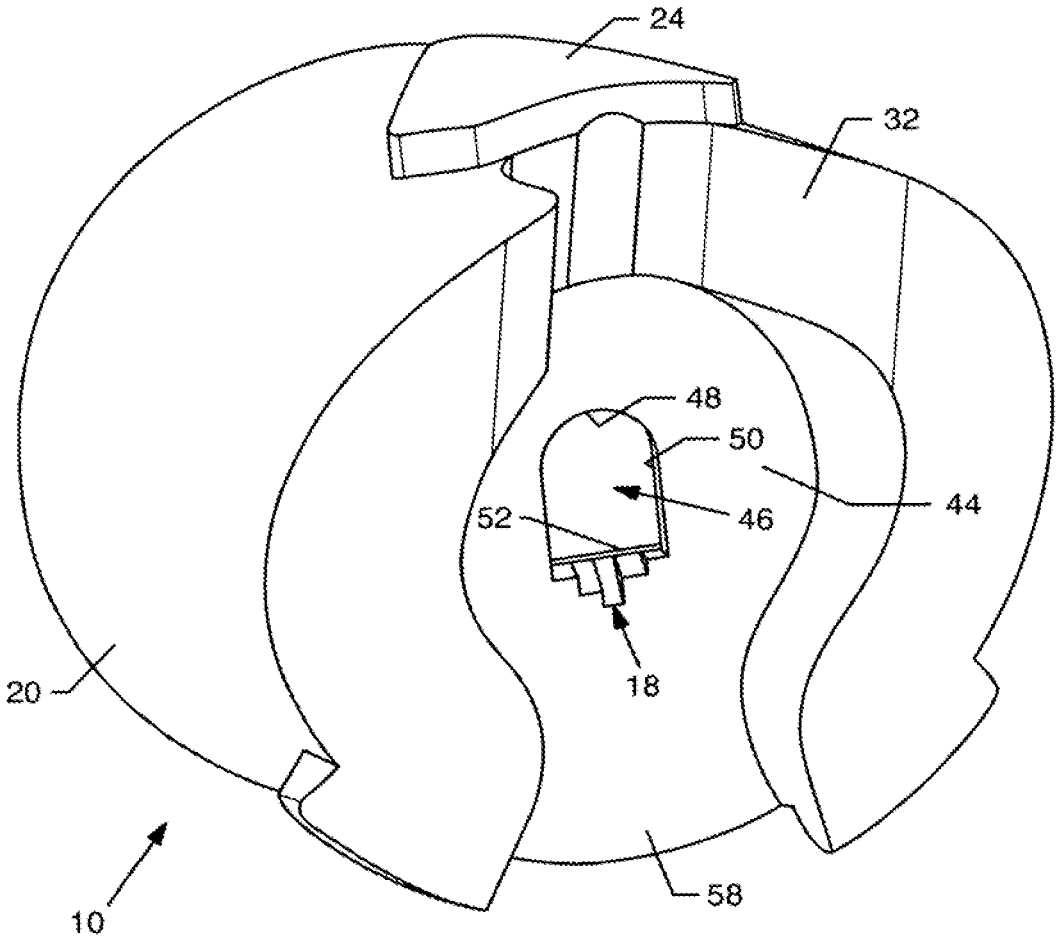
FIG. 3 is an enlarged front perspective view of the improved sprinkler nozzle of the present invention.
Figure 4:
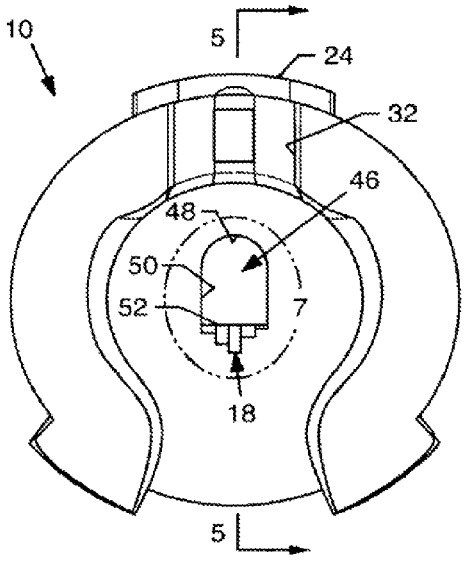
FIG. 4 is a front elevation view of the improved sprinkler nozzle of FIG. 3.
Figure 5:
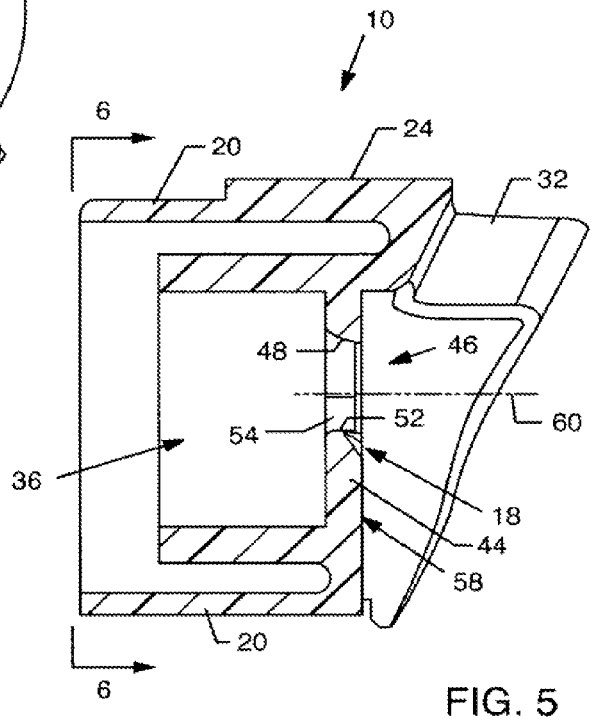
FIG. 5 is a vertical sectional view taken generally on the line 5-5 of FIG. 4.
Figure 6:
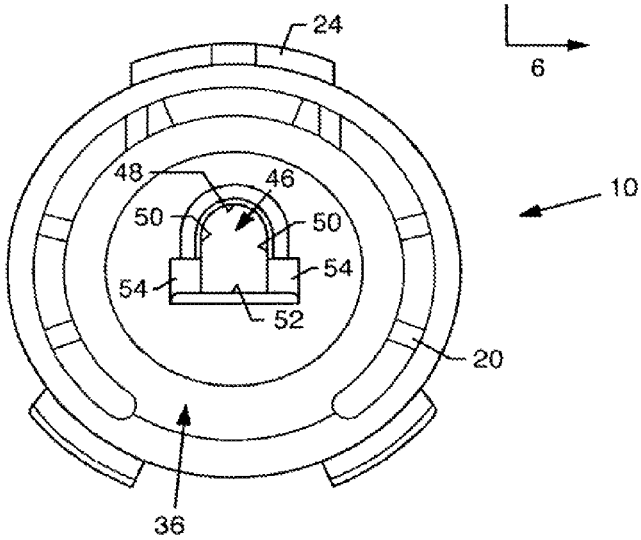
FIG. 6 is a rear elevation view of the sprinkler nozzle, taken generally on the line 6-6 of FIG. 5.

As shown in the exemplary drawings, an improved irrigation sprinkler nozzle referred to generally by the reference numeral 10 is provided for use in an irrigation sprinkler 12 as viewed in FIGS. 1 and 2. The improved nozzle 10 is mounted on a spray head 14 carried at the upper end of a tubular riser 16, and functions to project a stream of irrigation water outwardly from the sprinkler 12 to irrigate a surrounding terrain area. In accordance with the invention, the improved nozzle 10 incorporates a plurality of forwardly extending ramps 18 each formed with a selected width and a different declination angle for forcing and downwardly guiding a portion of the water stream discharged from the nozzle passage for enhanced short range or close-in distribution of a portion of the irrigation water stream over a terrain zone disposed immediately adjacent to the sprinkler 12.

The illustrative drawings show the sprinkler 12 to include a generally cylindrical housing or case 19 of a type adapted for connection to a supply of irrigation water under pressure. The tubular riser 16 may comprise a pop-up riser carried within the sprinkler housing 19 in a normal retracted position withdrawn substantially into and concealed within the housing 19 when the water supply is turned off. When the water supply is turned on to deliver water under pressure to the sprinkler, the riser 16 is displaced or popped up to an elevated spraying position as viewed in FIG. 1, with the spray head 14 exposing the nozzle 10 for outward projection of the water stream to irrigate the surrounding terrain. In one preferred form, the sprinkler 12 includes a rotary drive means (not shown) of a type known in the art, such as a water-driven gear drive mechanism mounted within the tubular riser, 16, for rotatably driving and the spray head 14 thereon in a manner sweeping the projected water stream through a full-circle or selected part-circle arcuate path. Alternately, it will be appreciated that the spray head 14 equipped with the improved nozzle 10 of the present invention may be installed onto a fixed tubular riser which is not associated with a rotary drive means, and/or which supports the nozzle 10 in an exposed position without requiring pop-up movement when the water supply is turned on.

The improved sprinkler nozzle 10 of the present invention, as shown in one preferred form in the accompanying illustrative drawings, may be formed from lightweight molded plastic of the like in the form of a generally cylindrical body 20 having a size and shape for mating slide-fit reception into a forwardly open, generally cylindrical cavity 22 formed in the sprinkler spray head 14 (FIG. 2). An upper key 24 is formed on this body 20 at a top or upper side thereof for slide-fit reception into an expanded diameter keyway 26 at the top of the cavity 22, for rotationally orienting the nozzle 10 relative to the spray head 14. A threaded adjustment screw 28 (FIG. 2) is mounted on the spray head 14 within a threaded bore 30 so that threaded shank thereof extends downwardly through a forwardly open notch 32 formed in the nozzle body 20, for securely but removably retaining the nozzle body 20 seated within the cavity 22. In this position, a rear or upstream face of the nozzle body 20 is retained in seated relation upon a generally forwardly presented annular seat 34 formed at the base of the nozzle cavity 22. A slotted upper end of the adjustment screw 28 is exposed at the top side of the spray head 14 (FIG. 1) and may be engaged by a screwdriver or the like (not shown) for advancing or retracting the screw 28 to accommodate removable nozzle installation. The adjustment screw 28 may also be adjustably positioned for advancing a tip 29 (FIG. 2) thereof into interrupting engagement with an upper portion of the projected water stream to regulate the stream range in a manner known in the art.

The body 20 of the sprinkler nozzle 10 defines an open nozzle passage 36 which is aligned with a water flow path 38 (FIG. 2) extending through the riser 16 and spray head 14, when the nozzle 10 is mounted onto the sprinkler spray head 14. Accordingly, when water under pressure is coupled to the riser 16, this water flow travels through the riser flow path 38 and further through the nozzle passage 36 which produces the desired tailored and contoured outwardly projected water stream for irrigating the surrounding terrain area. In accordance with a primary aspect of the present invention, at least a portion of this outwardly projected water stream includes a generally vertically oriented fan-like spray pattern segment 40 (FIG. 1), wherein a lower edge or region 42 of this fan-like spray pattern 40 is forced and guided downwardly by the angled ramps 18 formed on the nozzle 10 for improved short range or close-in water distribution near the sprinkler 12. In accordance with a further important aspect of the invention, this portion of the water stream forced and guided downwardly by the ramps 18 is provided in the form of substantially small and relatively fine water droplets which will fall softly to the ground at relatively low velocity and thereby will not disturb or erode newly planted seed beds, particularly such as relatively small grass seed of the type used for a newly planted lawn.

As viewed best in FIGS. 3-4 and 6-7, in accordance with one exemplary form of the invention, the passage 36 formed in the sprinkler nozzle 10 has a relatively large cross sectional size and shape such as a generally cylindrical shape having an upstream end sized for substantial alignment with a downstream end of the flow path 38 formed in the spray head 14. A nozzle faceplate 44 is formed at a downstream end of the nozzle passage 36 and has a contoured nozzle outlet 46 formed therein. As shown in one preferred form for use with a rotary drive sprinkler, this nozzle outlet 46 has a generally tombstone-shaped configuration defined by a generally arched or semicircular upper margin 48 joined to relatively straight upright side margins 50 which are joined in turn to a lower margin 52 which is also relatively straight. At the upstream or inboard side of the faceplate 44, the upright side margins 50 incorporate means for laterally constricting the water flow over at least a lower segment thereof, such as a pair of tapered transition surfaces 54 extending angularly forwardly and converging transversely or laterally inwardly toward each other.

With this configuration, water under pressure projected outwardly from the nozzle 10 via the nozzle outlet 46 includes a generally cylindrical or semi-cylindrical, and substantially collimated upper stream segment 56 (FIG. 1) for relatively long range projection from the sprinkler 12 and associated distribution over a terrain zone disposed a substantial distance from the sprinkler. The laterally converging tapered transition surfaces 54 at the inboard or upstream sides of the outlet side margins 50 effectively redirect a lower portion of the water flow into laterally or transversely converging impingement to produce the lower, generally vertically oriented fan-like spray pattern segment 40 for comparatively shorter range projection from the sprinkler 12 and associated distribution over a terrain zone located comparatively closer to the sprinkler. Further description of such means for producing a fan-like spray pattern is provided in U.S. Pat. No. 5,299,742, which is incorporated by reference herein.

The ramps 18 comprise a plurality of individual tapered surfaces formed generally at a front side of the nozzle faceplate 44, in a side-by-side array spanning a substantial portion and preferably the entire width of the lower margin 52 of the nozzle outlet 46. In this regard, the illustrative drawings show a plurality of five side-by-side ramps 18 each having a selected transverse width which may be the same or different, and extending forwardly and angularly downwardly with a selected declination angle which is different from the adjacent ramp or ramps, and more preferably different from the declination angle of any one of the other ramps. In addition, each of the ramps 18 extends forwardly and downwardly from an upstream or inboard end disposed at least a short distance upstream relative to a frontal face plane 58 defined by an outboard side of the nozzle faceplate 44, and terminating at a downstream end shown substantially at said frontal face plane 58 of the faceplate 44. These upstream ends of the individual ramps 18, however, are formed at least a short distance downstream relative to initial convergence of the water flow to form the fan-like spray pattern 40, as defined by an upstream or inboard end of the tapered transition surfaces 54.

Figure 7:
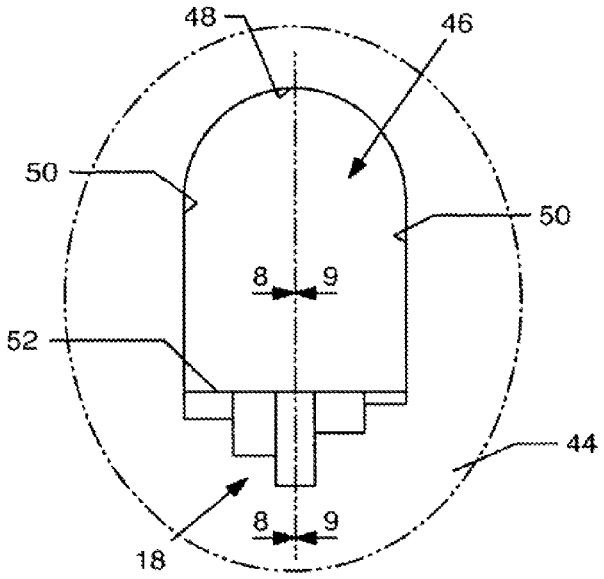
FIG. 7 is an enlarged and fragmented front elevation view of the sprinkler nozzle, correspondingly generally with the encircled region 7 of FIG. 4.
Figure 8:
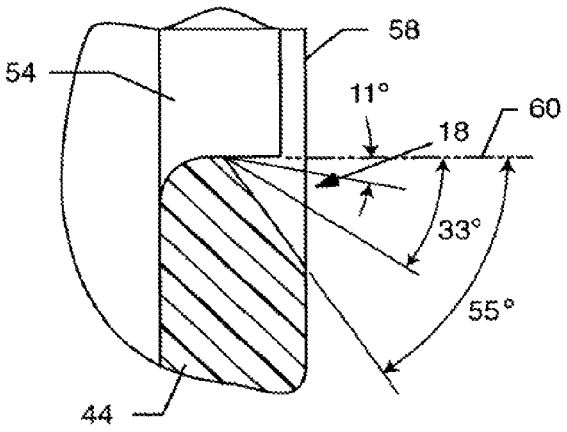
FIG. 8 is a further enlarged and fragmented vertical sectional view taken generally on the line 8-8 of FIG. 7.
Figure 9:
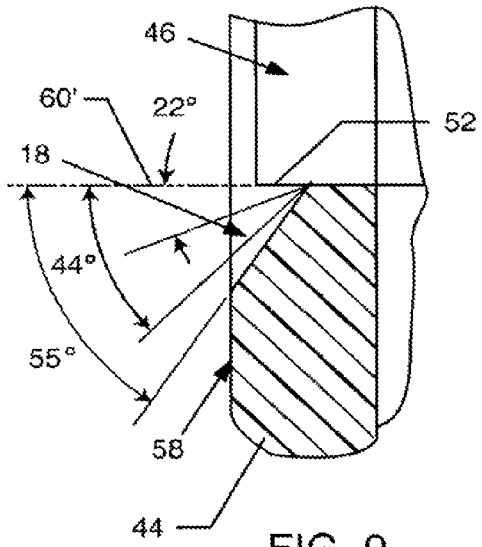
FIG. 9 is a further enlarged and fragmented vertical sectional view taken generally on the line 9-9 of FIG. 7.

More particularly, as viewed best in FIGS. 7-9, in accordance with one preferred five-ramp geometry, a central ramp 18 extends forwardly and downwardly at a relatively steep angle shown as about 55° relative to a line 60' extending parallel to a central axis 60 of the nozzle outlet 46. At the opposed sides of this steep central ramp, a pair of intermediate ramps are shown to extend forwardly and downwardly at somewhat shallower but different angles shown as about 44° and about 33°, respectively. These intermediate ramps are in turn flanked by a pair of outer ramps shown to extend forwardly and downwardly at still shallower but different angles of about 22° and about 11° respectively.

With this construction, the lower edge region 42 (FIG. 1) of the fan-like spray pattern segment 40 projected from the sprinkler nozzle 10 for relatively short range irrigation is forced and guided downwardly by the multiple ramps 18 at different angles for achieving significantly improved close-in distribution of water near the sprinkler, with a significant water distribution occurring substantially at or within a few inches of the sprinkler 12. This close-in water distribution beneficially takes the form of a small and relatively fine water droplets which fall softly to the ground and thereby avoid eroding or disturbing newly planted seed beds, such as relatively small grass seed of the type used for a newly planted lawn. In this regard, it is believed that positioning of the upstream or inboard ends of the ramps 18 at a location disposed upstream relative to the front plane 58 of the nozzle faceplate 44, but at least slightly downstream relative to initial water flow convergence to produce the vertical fan pattern 40, results in a rapid pressure reduction in the vicinity of the lower margin 52 of the nozzle outlet 46, to enhance the formation of this desired small and relatively fine water droplets which is forced and guided downwardly by the ramps 18. The resultant enhancement in close-in water distribution occurs without significantly impacting the projected range of the upper collimated stream segment 56 or the long range distribution to the surrounding terrain.

A wide range of variations in and to the configuration of the ramps 18 may be employed. By way of illustrative example, improved close-in water distribution is achieved by the use of multiple ramps 18, although an array of at least three side-by-side ramps of selected widths and selected different declination angles is preferred. The specific ramp widths and declination angles may be custom-tailored to controllably increase or decrease the particular distribution pattern of water within a close-in terrain zone. That is, a wider and/or deeper ramp will generally draw a greater proportion of the water stream than a narrower and/or shallower ramp, and a more steeply tapered ramp will generally deliver the water to the ground at a location closer to the sprinkler than a ramp tapered at a reduced angle. In addition, if desired, alternative ramp configurations such as curved, stepped, V-shaped, and the like may be used, and/or the downstream or outboard end of the ramps may be formed to extend substantially to or beyond the front plane 55 of the nozzle faceplate 44.

A variety of further modifications and improvements in and to the improved sprinkler nozzle 10 of the present invention will be apparent to those persons skilled in the art. Accordingly, no limitation on the invention is intended by way of the foregoing description and accompanying drawings, except as set forth in the appended claims.

What is claimed is:

1. An irrigation sprinkler nozzle for discharging a stream of fluid, comprising:

a nozzle body defining a nozzle passage having an upstream end for mounting in flow communication with a supply of water under pressure, and a downstream end defining a nozzle outlet for outward projection of a water stream to irrigate surrounding terrain, the water stream including an upper stream segment to irrigate a terrain zone disposed a first distance from the sprinkler nozzle and a lower stream segment to irrigate terrain disposed a second distance from the sprinkler nozzle, the first distance being greater than the second distance;

said nozzle outlet including a lower margin, an upper margin and a pair of side margins connecting the upper and lower margins, and having an outboard side defining a front face, the lower margin, upper margin and side margins surrounding the nozzle outlet at the front face; and a plurality of discrete ramps formed at said lower margin of said nozzle outlet and extending forwardly and angularly downwardly therefrom, the upper and side margins being free of said ramps, each such discrete ramp having a different selected declination angle than an adjacent ramp and arranged in a side-by-side array along said lower margin of said nozzle outlet such that a sidewall is formed between adjacent ramps, each of said ramps having an upstream end disposed a distance upstream relative to said front face of said nozzle outlet, whereby a portion of the water passing through said nozzle outlet is guided downwardly generally along said ramps to form at least part of the lower stream segment to irrigate surrounding terrain relatively close to the sprinkler nozzle.

2. The irrigation sprinkler nozzle of claim 1 wherein each of said ramps has a selected width and a selected different declination angle.

3. The irrigation sprinkler nozzle of claim 1 wherein said plurality of ramps includes at least three ramps.

4. The irrigation sprinkler nozzle of claim 1 wherein said ramps are arranged in a side-by-side array spanning substantially the entire width of said lower margin of said nozzle outlet.

5. The irrigation sprinkler nozzle of claim 1 wherein said nozzle outlet is further shaped to form at least the upper portion of said stream with a substantially collimated spray pattern.

6. The irrigation sprinkler nozzle of claim 1 wherein said nozzle outlet further includes means formed generally at an upstream side thereof for laterally converging water flowing through said nozzle outlet to produce a generally vertically oriented fan spray pattern.

7. The irrigation sprinkler nozzle of claim 6 wherein each of said ramps has an upstream end disposed at least a short distance downstream relative to initial convergence of water by said converging means.

8. The irrigation sprinkler nozzle of claim 1 wherein said nozzle outlet further includes laterally converging tapered transition surfaces formed generally at an upstream side thereof, and at opposite sides of said nozzle outlet, for laterally converging water flowing through said nozzle outlet to produce a generally vertically oriented fan spray pattern.

9. The irrigation sprinkler nozzle of claim 8 wherein each of said ramps has an upstream end disposed at least a distance downstream from an upstream end of said laterally converging tapered transition surfaces.

10. The irrigation sprinkler nozzle of claim 1 wherein said nozzle outlet has a generally tombstone-shaped configuration wherein the upper margin is arched, the side margins are generally straight, and said lower margin is generally straight.

11. The irrigation sprinkler nozzle of claim 10 wherein said side margins further include laterally converging tapered transition surfaces formed generally at an upstream side thereof, and at opposite sides of said nozzle outlet to extend over a lower region thereof, for laterally converging water flowing through said nozzle outlet to produce said generally vertically oriented spray pattern, each of said ramps having an upstream end disposed a distance downstream from an upstream end of said laterally converging tapered transition surfaces.

12. An irrigation sprinkler nozzle for discharging a stream of fluid, comprising:

a nozzle body defining a nozzle passage having an upstream end for mounting in flow communication with a supply of water under pressure, and a downstream end defining a nozzle outlet for outward projection of a water stream to irrigate surrounding terrain, the water stream including an upper stream segment to irrigate a terrain zone disposed a first distance from the sprinkler nozzle and a lower stream segment to irrigate terrain disposed a second distance from the sprinkler nozzle, the first distance being greater than the second distance;

said nozzle outlet including a lower margin, and having an outboard side defining a front face plane; and a plurality of discrete ramps formed at said lower margin of said nozzle outlet and extending forwardly and angularly downwardly therefrom each with a different declination angle than an adjacent ramp and arranged in a side-by-side array along said lower margin of said nozzle outlet such that a sidewall is formed between at least a pair of adjacent ramps, each of said ramps having an upstream end disposed upstream relative to said front face plane of said nozzle outlet and sharing a common upstream plane with adjacent ramps and a downstream end sharing a common downstream plane with adjacent ramps, whereby a portion of the water passing through said nozzle outlet is forced and guided downwardly generally along said ramps to form at least part of the lower stream segment to irrigate surrounding terrain relatively close to the sprinkler nozzle.

13. The irrigation sprinkler nozzle of claim 12 wherein said plurality of ramps comprises at least three of said ramps.

14. The irrigation sprinkler nozzle of claim 12 wherein said ramps are arranged in a side-by-side array spanning substantially the entire width of said lower margin of said nozzle outlet.

15. The irrigation sprinkler nozzle of claim 12 wherein said nozzle outlet is further shaped to form at least the upper portion of said stream with a substantially collimated spray pattern.

16. The irrigation sprinkler nozzle of claim 12 wherein said nozzle outlet further includes laterally converging tapered transition surfaces formed generally at an upstream side thereof, and at opposite sides of said nozzle outlet, for laterally converging water flowing through said nozzle outlet to produce said generally vertically oriented fan spray pattern, each of said ramps having an upstream end disposed a distance downstream from an upstream end of said laterally converging tapered transition surfaces.

17. The irrigation sprinkler nozzle of claim 12 wherein said nozzle outlet has a generally tombstone-shaped configuration defining an arched upper margin joined to a pair of generally straight side margins, said side margins being joined in turn to said lower margin which is also generally straight.

18. The irrigation sprinkler nozzle of claim 12 wherein the nozzle outlet includes an upper margin and a pair of side margins connecting the upper and lower margins, the upper margin, side margins and lower margin surrounding the nozzle outlet at the front face plane and the upper and side margins being free of said ramps.

19. An irrigation sprinkler nozzle for discharging a stream of fluid, comprising:

a nozzle body defining a nozzle passage having an upstream end for mounting in flow communication with a supply of water under pressure, and a downstream end defining a nozzle outlet for outward projection of a water stream to irrigate surrounding terrain, the water stream including an upper stream segment to irrigate a terrain zone disposed a first distance from the sprinkler nozzle and a lower stream segment to irrigate terrain disposed a second distance from the sprinkler nozzle, the first distance being greater than the second distance;

said nozzle outlet said nozzle outlet further including laterally converging tapered transition surfaces formed generally at an upstream side thereof and at opposite sides of said nozzle outlet for laterally converging water flowing through said nozzle outlet to form at least a lower portion of said stream with a generally vertically oriented fan shaped spray pattern;

said nozzle outlet including a lower margin, and having an outboard side defining a front face plane; and a plurality of discrete ramps formed at said lower margin of said nozzle outlet and extending forwardly and angularly downwardly therefrom each such discrete ramp having a different declination angle from an adjacent ramp and arranged in a side-by-side array along said lower margin of said nozzle outlet such that a sidewall is formed between adjacent ramps, each of said ramps having an upstream end disposed a distance upstream relative to said front face plane of said nozzle outlet and sharing a common upstream plane with adjacent ramps and a downstream end a distance downstream from an upstream end of said laterally converging tapered transition surfaces and sharing a common downstream plane with adjacent ramps, whereby a portion of the water passing through said nozzle outlet is forced and guided downwardly generally along said ramps to form at least part of the lower stream segment to irrigate surrounding terrain relatively close to the sprinkler nozzle.

20. The irrigation sprinkler nozzle of claim 19 wherein said plurality of ramps comprises at least three of said ramps.

21. The irrigation sprinkler nozzle of claim 19 wherein said ramps are arranged in a side-by-side array spanning substantially the entire width of said lower margin of said nozzle outlet.

22. The irrigation sprinkler nozzle of claim 19 wherein said nozzle outlet is further shaped to form at least the upper portion of said stream with a substantially collimated spray pattern.

23. The irrigation sprinkler nozzle of claim 19 wherein said nozzle outlet has a generally tombstone-shaped configuration defining an arched upper margin joined to a pair of generally straight side margins, said side margins being joined in turn to said lower margin which is also generally straight.

24. The irrigation sprinkler nozzle of claim 19 wherein the nozzle outlet includes an upper margin and a pair of side margins connecting the upper and lower margins, the upper margin, side margins and lower margin surrounding the nozzle outlet at the front face plane and the upper and side margins being free of said ramps.

25. An irrigation sprinkler nozzle, comprising:

a nozzle body defining a nozzle passage having an upstream end for mounting in flow communication with a supply of water under pressure, and a downstream end defining a nozzle outlet for outward projection of a water stream to irrigate surrounding terrain, said nozzle outlet including a lower margin, and having an outboard side defining a front face, said nozzle outlet having a generally tombstone-shaped configuration defining an arched upper margin joined to a pair of generally straight side margins, said side margins being joined in turn to said lower margin which is also generally straight; and a plurality of discrete ramps formed at said lower margin of said nozzle outlet and extending forwardly and angularly downwardly therefrom, each such discrete ramp having a different selected declination angle than an adjacent ramp and arranged in a side-by-side array along said lower margin of said nozzle outlet such that a sidewall is formed between adjacent ramps, each of said ramps having an upstream end disposed a distance upstream relative to said front face of said nozzle outlet, whereby a portion of the water passing through said nozzle outlet is guided downwardly generally along said ramps to irrigate surrounding terrain relatively close to the sprinkler nozzle.

26. The irrigation sprinkler nozzle of claim 25 wherein said side margins further include laterally converging tapered transition surfaces formed generally at an upstream side thereof, and at opposite sides of said nozzle outlet to extend over a lower region thereof, for laterally converging water flowing through said nozzle outlet to produce said generally vertically oriented spray pattern, each of said ramps having an upstream end disposed a distance downstream from an upstream end of said laterally converging tapered transition surfaces.

27. An irrigation sprinkler nozzle, comprising:

a nozzle body defining a nozzle passage having an upstream end for mounting in flow communication with a supply of water under pressure, and a downstream end defining a nozzle outlet for outward projection of a water stream to irrigate surrounding terrain, said nozzle outlet including a lower margin;

a faceplate generally at said downstream end of said nozzle passage, said faceplate having said nozzle outlet formed therein; and a plurality of discrete ramps formed at said lower margin of said nozzle outlet and extending forwardly and angularly downwardly therefrom, each such discrete ramp having a different selected declination angle than an adjacent ramp and arranged in a side-by-side array along said lower margin of said nozzle outlet such that a sidewall is formed between adjacent ramps, each of said ramps having an upstream end disposed a distance upstream relative to said front face of said nozzle outlet, whereby a portion of the water passing through said nozzle outlet is guided downwardly generally along said ramps to irrigate surrounding terrain relatively close to the sprinkler nozzle, a segment of the nozzle outlet at the faceplate being free of the ramps.

* * * * *

UNITED STATES PATENT AND TRADEMARK OFFICE

CERTIFICATE OF CORRECTION

PATENT NO. : 8,640,978 B2
APPLICATION NO. : 12/025499
DATED : February 4, 2014
INVENTOR(S) : Christian T. Gregory and John J. Alarcon It is certified that error appears in the above-identified patent and that said Letters Patent is hereby corrected as shown below:

In the Claims

Column 9, line 9, delete "said nozzle outlet said nozzle outlet" and insert --said nozzle outlet-- therefor.

Signed and Sealed this
Eighth Day of July, 2014

Michelle K. Lee

Michelle K. Lee
*Deputy Director of the United States Patent and Trademark Office*